US005204229A

United States Patent [19]

Nakamura et al.

[11] Patent Number: 5,204,229

[45] Date of Patent: Apr. 20, 1993

[54] REPLENISHING SOLUTION UNIT FOR PREPARING A COLOR DEVELOPING SOLUTION AND METHOD FOR PROCESSING A COLOR PHOTOGRAPHIC LIGHT-SENSITIVE MATERIAL THEREWITH

[75] Inventors: Koichi Nakamura; Masato Taniguchi, both of Kanagawa, Japan

[73] Assignee: Fuji Photo Film Co., Ltd., Kanagawa, Japan

[21] Appl. No.: 795,728

[22] Filed: Nov. 21, 1991

[30] Foreign Application Priority Data

Nov. 21, 1990 [JP] Japan ..... 2-314104

[51] Int. Cl.[5] ..... G03C 5/30; G03C 5/31; G03C 7/44

[52] U.S. Cl. ..... 430/399; 430/464; 430/490; 430/466; 430/467; 430/433

[58] Field of Search ..... 430/399, 490, 466, 467, 430/433, 464

[56] References Cited

U.S. PATENT DOCUMENTS

| | | | |
|---|---|---|---|
| 3,647,461 | 3/1972 | Surash et al. | 430/466 |
| 5,006,456 | 4/1991 | Morigaki et al. | 430/467 |
| 5,077,180 | 12/1991 | Yoshida et al. | 430/399 |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A replenishing solution unit for color-developing a color photographic light-sensitive material is disclosed. The replenishing solution unit comprises at least (1) a replenishing solution containing a color developing agent and a sulfinic acid or a salt thereof and the pH of said replenishing solution is 2 to 6 and (2) a replenishing solution containing a replenishing solution component other than the color developing agent. The replenishing solution unit enables the preparation of a concentrated developing solution and has excellent storage stability over a long period of time without the decrease of photographic sensitivity and the increase of $D_{min}$. A method for processing a color photographic light-sensitive material with the above replenishing solution unit is also disclosed.

12 Claims, No Drawings

REPLENISHING SOLUTION UNIT FOR PREPARING A COLOR DEVELOPING SOLUTION AND METHOD FOR PROCESSING A COLOR PHOTOGRAPHIC LIGHT-SENSITIVE MATERIAL THEREWITH

FIELD OF THE INVENTION

The present invention relates to a replenishing solution for preparing a color developing solution and a method for processing a color photographic light-sensitive material with it.

BACKGROUND OF THE INVENTION

In general, a photographic processing solution for a silver halide photographic light-sensitive material is prepared for use by measuring and mixing many kinds of necessary components before using or it is an already-prepared photographic processing solution in which the necessary components are mixed in advance in the amounts needed.

A powder type processing agent and a solution type processing agent are known as photographic processing agents. A powder type processing agent is dissolved in a prescribed amount of water before use. In the case of a solution type processing agent, a concentrated solution is usually diluted with a fixed amount of water before use and a non-concentrated solution is used as it is without dilution with water. A ready-prepared photographic processing agent has various advantages since less fluctuation in the quality of a processing solution occurs in its direct use and it can be readily used. Meanwhile, it contains many substances which readily react with each other by an oxidation-reduction reaction and therefore, it is usually separated into one or two kinds of components, which are packaged in a kit form, (hereinafter called a Part) and these components are dissolved in a prescribed amount of water before use.

In recent years, in order to prevent processing solutions from deteriorating during processing, a replenishing treatment is used for the purpose of replenishing the components used up wherein a fixed amount of a replenishing solution per processed unit area of the photographic material is supplied to a processing bath. In this case, the replenishing solution is usually supplied by an automatic supplying pump, where the replenishing solution prepared by dissolving the foregoing packaged part is pumped to a replenishing tank and is automatically supplied therefrom.

The photographic processing agent in which the above parts are packaged in kit form is dissolved, diluted, mixed and then adjusted to a prescribed amount for use as the replenishing solution for color development. However, this photographic processing agent has the following problem: that is, the reducing agent present in the photographic processing agent, for example, a developing agent, is quite unstable in a solution even if it is separately packaged in a kit as a part and this tendency is particularly notable for a p-phenylenediamine type color developing agent.

Methods for stabilizing a liquid kit part containing a p-phenylenediamine type color developing agent are described in, for example, JP-B-45-37957 (the term "JP-B" as used herein means an examined Japanese patent publication), in which a prescribed amount of sulfite is added to an acidic aqueous solution containing the p-phenylenediamine color developing agent; U.S. Pat. No. 3,574,619, in which benzyl alcohol, ethylene glycol and sulfite are added to an acidic aqueous solution containing the p-phenylenediamine color developing agent; and JP-B-55-21084 and JP-B-1-46866, in which sulfite is added to a solution prepared by dissolving the p-phenylenediamine color developing agent in an organic solvent. However, in these conventional methods, the sulfite is rapidly decomposed and sulfur dioxide is generated, which is disadvantageous in a working environment, and in addition, the decomposition of the color development agent rapidly goes on when the concentration of the sulfite is markedly lowered.

Means for solving the problems of rapid decomposition of sulfite and the lack of stability of a developing agent include the method described in, for example, JP-A-51-26543 (the term "JP-A" as used herein means an unexamined published Japanese patent application), in which p-phenylenediamine phosphate is used in place of the sulfite to achieve developing solution stability, JP-A-47-24323, in which the solution containing a p-phenylenediamine color developing agent and sulfite in a fixed amount are sealed in a vessel of a polymer material having a low air permeation coefficient; and further, JP-A-59-210439, in which the pH of the solution containing an N-hydroxyalkyl-substituted p-phenylenediamine color developing agent and sulfite is adjusted to 6 to 8 to achieve developing solution stability.

However, satisfactory stability has not yet been achieved with these prior art techniques since the decomposition goes on slowly even if the developing solution is stored in a sufficiently tightly closed vessel and decomposition of the sulfite is expedited after the vessel is opened and the developing solution is exposed to air.

Further, the dissolution of a color developing agent in preparing a developing solution is not sufficiently improved. Especially, the method described in JP-A-59-210439 has a problem in that a condensed part can not be prepared because of the lower solubility of a color developing agent.

Also, the amount of a developing agent dissolvable is lower in a solution of higher pH, in which a preservative and an alkaline component are present, than in a solution of neutral or lower pH, and it is difficult to increase the concentration of the solution. Consequently, where a lot of the developing solution has to be replenished, the replenishing amount has to be increased, and this results in an increase in the amount of over-flowing waste from a developing solution bath.

Because of the complexity in processing a photographic processing waste to render it non-hazardous and an environmentally acceptable photographic processing waste, in recent years a decrease in developing waste in the photographic processing or elimination of the waste has been required. To meet this requirement, one could consider increasing the concentration of the developing agent in the replenishing solution for development to decrease the replenishing amount so that the developing solution does not over flow. However, even if increasing the concentration of the developing agent in the replenishing solution for development is attempted, it is difficult to increase the amount of the developing agent which will dissolve where high pH components such as alkaline components are present in the replenishing solution for development.

In order to achieve a higher concentration of the developing agent in the developing solution as well as storage stability, usually a packaging form consisting of a part containing a concentrated solution of the color developing agent and the sulfite or the color developing agent, the sulfite and a chelating agent, and a part containing the concentrated solution of the alkaline components are used, wherein the former part is acidified (low pH) and has the function of increasing the solubility. These concentrated solutions are particularly needed for lower replenishment and/or the preparation of a high activity developing solution.

However, it has been found that while the solubility of the developing agent is increased at a pH of 6 or higher, there is the tendency for the sulfite compound to decompose and generate sulfur dioxide and the developing agent is degraded. Therefore, this type of packaging form is not preferable especially for long storage. More specifically, when the replenishment was carried out after long storage, the minimum density ($D_{min}$) of the photographic image is increased and the sensitivity is decreased as the developing agent is degraded.

Further, the use of a large amount of sulfite depresses the color developing reaction since an oxidation product of the developing agent is captured. Especially when a silver halide color photographic light-sensitive material with a high content of silver chloride is subjected to color development, the density of the color image is markedly reduced because of the dissolution of silver chloride by the sulfite. Therefore, it is not preferable to add sulfite in an amount sufficient to provide storage over a long period of time.

Meanwhile, with respect to the stability of the developing agent itself, it is reported in *The Journal of Photographic Science,* vol. 31, pp. 177 to 180 (1983) that in the condition of low pH, the formation of a small amount of an oxidation product of the developing agent lowers the stability of the developing solution due to rapid hydrolysis (deamination) of the oxidation product of the developing agent, which takes place following the oxidation reaction of the developing agent.

Further, it is difficult to maintain developing solution stability over a long period of time at a pH of 7 or lower, especially under conditions of exposure to air, even using antioxidation agents other than sulfite (JP-A-63-30644, JP-A-60-106564 and JP-A-59-210439).

SUMMARY OF THE INVENTION

An object of the present invention is to provide a replenishing solution for preparing a developing solution, which has low pH (less than 6) enabling the preparation of a concentrated developing solution and which has excellent storage stability over a long period of time without the decrease of photographic sensitivity and the increase of $D_{min}$, and a method for processing a color photographic light-sensitive material with the above replenishing solution.

The above object has been achieved by a replenishing solution unit for preparing a color developing solution used for color-developing a color photographic light-sensitive material, comprising at least (1) a replenishing solution containing a color developing agent and a sulfinic acid or a salt thereof and the pH of the replenishing solution is 2 to 6 (hereinafter called a replenishing solution A) and (2) a replenishing solution containing a replenishing solution component other than the color developing agent (hereinafter called a replenishing solution B).

DETAILED DESCRIPTION OF THE INVENTION

It has been found in the present invention that the oxidation and decomposition of the developing agent can be sufficiently prevented by adding a sulfinic acid including a salt thereof to the replenishing solution A for preparing the color developing solution and further that the sulfinic acid or salt has advantageous effects in preventing the developing agent from deteriorating under acidic conditions (pH 2 to 6) and controlling the generation of a tar formed by the deterioration of the developing agent. As a result, a color developing solution with high concentration has been successfully prepared. It has also been found in the present invention that the use of the replenishing solution A for preparing the color developing solution enables a stable processing even in a continuous (running) processing with a low replenishing amount, with less fluctuation of photographic sensitivity and minimum density ($D_{min}$). In the system in which the conventionally used sulfite is present, the sulfite itself has been decomposed to generate an odor and an anti-oxidation effect has been decreased thereby. In the present invention, however, this problem has been solved and the developing solution can be stored in a high concentration in a stable manner over a long period of time. Further, the present invention makes it possible to handle the developing solution in an open system.

JP-A-1-230039 (corresponding to U.S. Pat. No. 5,006,456) discloses that sulfinic acid and a salt thereof can be used in processing of a light-sensitive material especially for the purposes of improving the stability of a bleach-fixing solution and a fixing solution, or a washing step and a stabilizing step and preventing the generation of a stain. However, there is no particular disclosure that the stability of the developing solution having a low pH, e.g., of 2 to 6, can be improved as is the case in the present invention, and in a low replenishment developing processing, the fluctuation of photographic sensitivity and $D_{min}$ can be inhibited by using the replenishing solution stored over a long period of time.

Further, the sulfinic acid or a salt thereof used according to the present invention markedly improves the stability of the developing solution at low pH, e.g., 2 to 6, which has so far been found unstable, and therefore it is now possible to prepare the replenishing solution A at this low pH containing the developing agent in a high concentration. This concentrated replenishing solution A is effective particularly for high activity and low replenishing processing.

Especially when high activity and low replenishing processing is carried out, it is preferable to use a method in which the concentrated replenishing solution A of low pH containing the developing agent, which is prepared according to the present invention, and the replenishing solution B containing a replenishing solution component other than the developing agent are separately added directly to the color developing solution (a tank solution) without preparing the development replenishing solution as a tank solution before use. Further, it is preferable to add the respective replenishing solutions with a different timing and/or at different locations. Before adding to the tank solution, the replenishing solution A may be mixed with a third replenishing solution (hereinafter called a replenishing solution C) to lower the concentration of the color developing agent in the color developing solution. Typical examples of the replenishing solution C include water, buffer (pH 6 to 9), etc. From the standpoint of the simplification of the color developing solution, it is preferred that the replenishing solution unit of the present invention consists of the replenishing solutions A and B.

The replenishing solution unit according to the present invention is used preferably as a replenishing solution unit for preparing a color developing solution (the tank solution).

The sulfinic acid or salt thereof used in the present invention is preferably a compound in which at least one $-SO_2M$ group is combined with a substituted or unsubstituted aryl group or a substituted or unsubstituted heterocyclic group, wherein M is a cation. When the compound is added to the replenishing solution A containing a color developing agent having a low pH, the stability is improved.

The sulfinic acid or salt thereof used in the present invention is explained below in detail.

The sulfinic acid or salt thereof is preferably represented by formula (I):

$$R(SO_2M)_n \quad (I)$$

wherein R represents an alkyl group, an alkenyl group, an aralkyl group, a cycloalkyl group, an aryl group or a heterocyclic group, M represents a cation, and n is an integer of 1 or 2, provided that when R is an alkyl group, an alkenyl group, an aralkyl group or a cycloalkyl group, n is 1.

Next, the compound represented by formula (I) is explained below in detail.

In formula (I), R represents a substituted or unsubstituted alkyl group (for example, methyl, ethyl, n-propyl, hydroxyethyl, sulfoethyl, carboxyethyl and methoxyethyl), a substituted or unsubstituted alkenyl group (for example, allyl and butenyl), a substituted or unsubstituted aralkyl group (for example, benzyl, phenethyl, 4-carboxyphenylmethyl, and 3-sulfophenylmethyl), a substituted or unsubstituted cycloalkyl group (for example, cyclohexyl), a substituted or unsubstituted aryl group (for example, phenyl, 4-methylphenyl, naphthyl, 3-carboxyphenyl, 4-methoxyphenyl, 3-sulfophenyl, 4-carboxymethoxyphenyl, 3-carboxymethoxyphenyl, 4-carboxyethoxyphenyl, 4-sulfoethoxyphenyl, 4-carboxymethylphenyl and 4-(N-carboxymethyl-N-methyl)-phenyl), or a substituted or unsubstituted heterocyclic group (for example, pyridyl, furyl, thienyl, pyrazolyl and indolyl), and M represents a cation (for example, hydrogen atom, alkali metal, alkali earth metal, nitrogen-containing organic base and ammonium group). Examples of suitable alkali metals are Na, K and Li. Examples of suitable alkali earth metals are Ca and Ba. Typical nitrogen-containing organic bases are amines capable of forming a salt with a sulfinic acid (for example, guanidine, hydroxyl amine, and aniline). Examples of suitable ammonium groups are an unsubstituted ammonium group and a tetramethyl ammonium group.

Examples of substitutents for the substituted alkyl group, the substituted alkenyl group, the substituted aralkyl group, the substituted cycloalkyl group, the substituted aryl group, or the substituted heterocyclic group include a nitro group, a halogen atom (e.g., a chlorine atom, a bromine atom, etc.), a cyano group, an alkyl group (e.g., a methyl group, an ethyl group, a propyl group, a carboxymethyl group, a carboxyethyl group, a carboxypropyl group, a sulfoethyl group, a sulfopropyl group, a dimethylaminoethyl group, etc.), an aryl group (e.g., a phenyl group, a naphthyl group, a carboxyphenyl group, a sulfophenyl group, etc.), an alkenyl group (e.g., an allyl group, a butenyl group, etc.), an aralkyl group (e.g., a benzyl group, a phenethyl group, etc.), a sulfonyl group (e.g., a methanesulfonyl group, a p-toluenesulfonyl group, etc.), an acyl group (e.g., an acetyl group, a benzoyl group, etc.), a carbamoyl group (e.g., an unsubstituted carbamoyl group, a dimethylcarbamoyl group, etc.), a sulfamoyl group (e.g., an unsubstituted sulfamoyl group, a methylsulfamoyl group, a dimethylsulfamoyl group, etc.), a carbonamido group (e.g., an acetamido group, a benzamido group, etc.), a sulfonamido group (e.g., a methanesulfonamido group, a benzenesulfonamido group, etc.), an acyloxy group (e.g., an acetyloxy group, a benzoyloxy group, etc.), a sulfonyloxy group (e.g., a methanesulfonyloxy group, etc.), a ureido group (e.g., an unsubstituted ureido group, etc.), a thioureido group (e.g., an unsubstituted thioureido group, a methylthioureido group, etc.), a carboxylic acid or a salt thereof, a sulfonic acid or a salt thereof, a hydroxy group, an alkoxy group (e.g., a methoxy group, an ethoxy group, a carboxyethoxy group, a carboxymethoxy group, a sulfoethoxy group, a sulfopropyloxy group, etc.), an alkylthio group (e.g., a methylthio group, a carboxymethylthio group, a sulfoethylthio group, etc.), or an amino group (e.g., an unsubstituted amino group, a dimethylamino group, an N-carboxyethyl-N-methylamino group, etc.), etc.

In formula (I), R is preferably a substituted or unsubstituted aryl group or a substituted or unsubstituted heterocyclic group, and is more preferably an aryl group substituted by at least one (preferably one to three) of an alkyl group having a carboxylic acid or a salt thereof or a sulfonic acid or a salt thereof, an alkoxy group having a carboxylic acid or a salt thereof or a sulfonic acid or a salt thereof and an alkylamino group having a .carboxylic acid or a salt thereof or a sulfonic acid or a salt thereof.

The above alkyl, alkoxy and alkylamino groups each has a carbon number of preferably 10 or less, more preferably 6 or less.

The total carbon number for R in formula (I) is preferably 20 or less, more preferably from 6 to 20.

The above aryl group is preferably a phenyl group or a naphthyl group, and more preferably a phenyl group.

In formula (I), n is preferably 1.

When the compound represented by formula (I) is added to the replenishing solution A containing a color developing agent having a low pH, and the running processing is carried out by using the replenishing solution A after storage over a long period of time, the formation of suspended matter in the tank solution and the reduction in photographic sensitivity can be inhibited.

Specific examples of the compounds represented by formula (I) of the present invention are shown below:

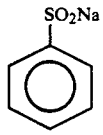

(S-1)

-continued
(S-2)
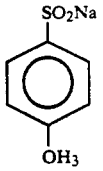
(S-3)
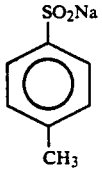
(S-4)
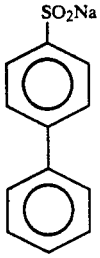
(S-5)
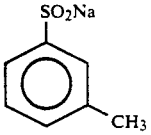
(S-6)
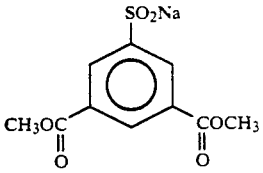
(S-7)
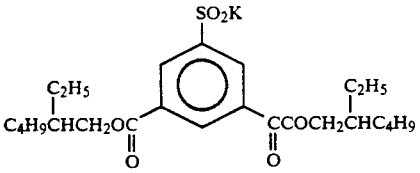
(S-8)
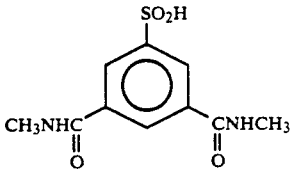
(S-9)
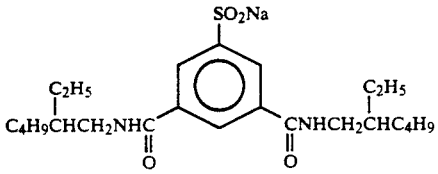
-continued
(S-10)
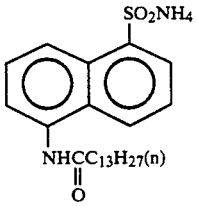
(S-11)
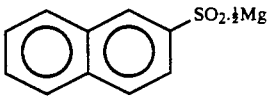
(S-12)
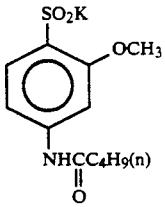
(S-13)
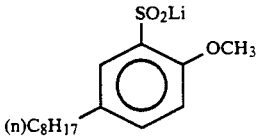
(S-14)
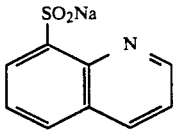
(S-15)
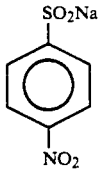
(S-16)
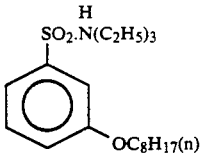
(S-17)
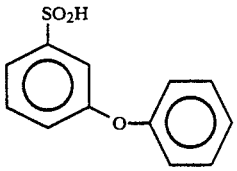
(S-18)
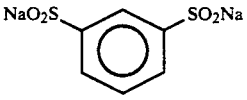
(S-19)
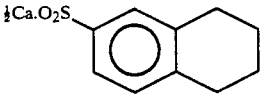

-continued
(S-20)
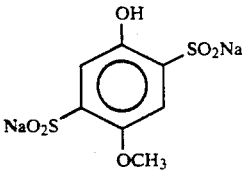
(S-21)
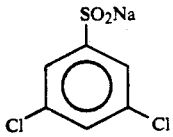
(S-22)
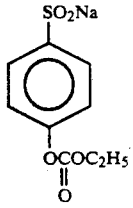
(S-23)
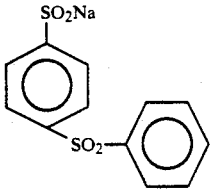
(S-24)
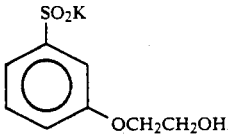
(S-25)
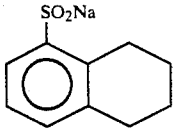
(S-26)
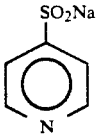
(S-27)
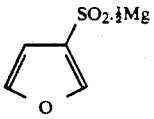
(S-28)
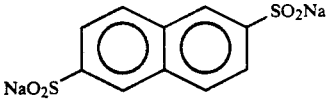
(S-29)
$(n)C_4H_9SO_2Na$
(S-30)
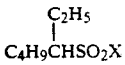
-continued
(S-31)
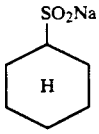
(S-32)
$CH_3OCH_2CH_2OCH_2CH_2SO_2NH_4$
(S-33)
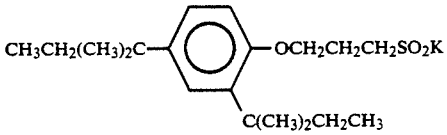
(S-34)
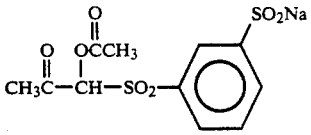
(S-35)
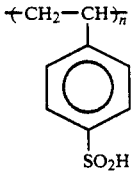
n = about 500
(S-36)
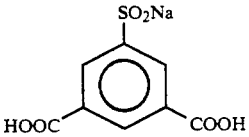
(S-37)
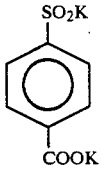
(S-38)
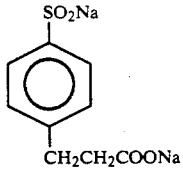
(S-39)
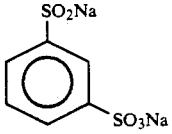
(S-40)
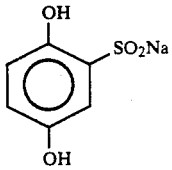

-continued (S-41)

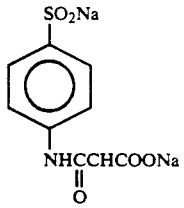

(S-42)

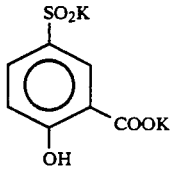

(S-43)

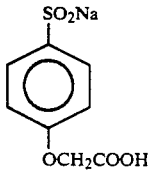

(S-44)

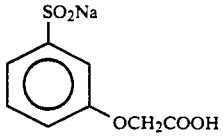

(S-45)

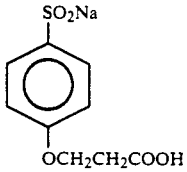

(S-46)

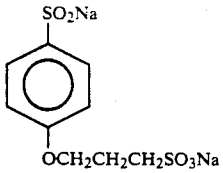

(S-47)

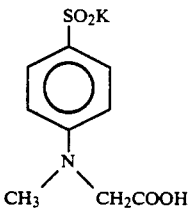

(S-48)

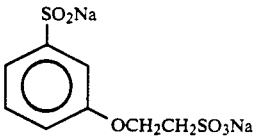

-continued (S-49)

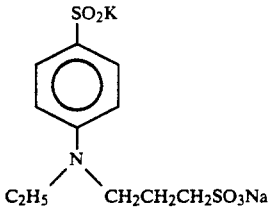

The above compounds can be used alone or as a combination of two or more thereof.

The above compounds can be synthesized by the method described in U.S. Pat. No. 4,770,987; *J. Am. Chem. Soc.*, 72, 1215 (1950); ibid., 62, 2596 (1940); ibid., 60, 544 (1938); ibid., 56, 1382 (1934); ibid., 57, 2166 (1935); ibid., 81, 5430 (1959); and *Chem. Rev.*, 48, 69 (1951).

Further, the amount of the sulfinic acid or a salt thereof used in the present invention is 0.001 to 1.0 mol/liter, preferably 0.002 to 0.2 mol/liter.

In the present invention, the parts of the replenishing solution unit for preparing a color developing solution comprise, two or more parts. The above replenishing agents can be maintained in a stable manner in a high concentration by separating them into two or more parts.

When the number of parts of the replenishing solution unit for preparing the developing solution is two or more, examples of combinations of the agents in the respective parts are shown below:

Two Part System

Part 1: a color developing agent, (an anti-oxidation agent).

Part 2: a buffer agent, an alkali agent, a chelating agent, an antifoggant, (an anti-oxidation agent), and a fluorescent whitening agent.

Three Part System

Part 1: a color developing agent, (an anti-oxidation agent).

Part 2: (an anti-oxidation agent), an anti-foggant, and a fluorescent whitening agent.

Part 3: a buffer agent, a chelating agent, (an anti-oxidation agent), and an alkali agent.

Four Part System

Part 1: a color developing agent, (an anti-oxidation agent).

Part 2: a development accelerator.

Part 3: a chelating agent, an anti-foggant, (an anti-oxidation agent), and a fluorescent whitening agent.

Part 4: a buffer agent and an alkali agent.

The anti-oxidation agent shown in parenthesis above may be added separately to the respective parts or may be added together to any of them.

These combinations are merely representative examples. In the present invention, several other combinations depending on the objects can be used. Furthermore, 5 or more parts can be used but the increase in the number of the parts is not preferred since there is a greater tendency for the preparation of the solutions to be complicate and for mistakes to occur in the preparation of the solutions. Therefore, the replenishing solution unit for preparing the developing solution preferably comprises a 2 to 4 part system.

When the replenishing solution unit for preparing the developing solution comprises of 2 or more parts, the amount of an aromatic primary amine color developing agent contained in one of these parts is preferably 5 to 450 g/liter. When a p-phenylenediamine derivative is used, it is particularly effective to use a sulfinic acid or a salt thereof at low pH. Representative examples of the developing agents which can be used in the present invention are shown below but the present invention is not limited thereto.

The color developing solution used in the present invention is explained below.

The color photographic light-sensitive material according to the present invention is preferably subjected to color developing, bleach-fixing and washing (or stabilizing) treatments. The bleaching and fixing treatments may be carried out separately, not together in one bath as described above.

The color developing solution used in the present invention contains an aromatic primary amine color developing agent. A preferable example thereof is a p-phenylenediamine derivative. Representative examples thereof are shown below but the present invention is not limited thereto.

D-1: 4-amino-N-ethyl-N-(8-hydroxyethyl)aniline

D-2: 4-amino-N-ethyl-N-(8-hydroxyethyl)-3-methylaniline

D-3: 4-amino-N-ethyl-N-(3-hydroxpropyl)-3-methylaniline

D-4: 4-amino-N-ethyl-N-(4-hydroxbutyl)-3-methylaniline

D-5: 4-amino-N-ethyl-N-(8-methanesulfoneamideethyl)-3-methylaniline

D-6: 4-amino-N-(3-carbamoylpropyl)-N-n-propyl-3-methylaniline

Of the above p-phenylenediamine derivatives, particularly preferred derivative is exemplified compound D-5 above and the sulfate, hydrochlorate, sulfite, naphthalenedisulfonate and p-toluenesulfonate salts of these p-phenylenediamine derivatives are also useful.

These aromatic primary amine color developing agents are used preferably in the amount of 0.0002 to 0.2 mole per liter of the developing solution, more preferably 0.001 to 0.1 mole per liter of the developing solution.

The upper limit of the amount of the aromatic primary amine color developing agent is up to about 600 g/liter. This upper limit is decided by the solubility of the developing agent in the replenishing solution of color development.

In the preparation of the replenishing solution unit for preparing the developing solution in Part 1, the other agents necessary for the color development may be present. It is preferable that the developing agent, and the sulfinic acid or a salt thereof are present in Part 1. It is more preferable that the anti-oxidation agent shown below is present therein in addition to the above agents.

The pH of the replenishing solution A is 2 or more and 6 or less, preferably 2.5 or more and 5.5 or less.

Various kinds of organic preservatives can be used for the purpose of preventing the oxidation of the color developing agent as described above. The stability of the replenishing solution A containing the developing agent can be further improved by using these anti-oxidation agents in combination. In the present invention, the replenishing solution A preferably contains an anti-oxidation agent.

Suitable organic preservatives are organic compounds capable of decreasing the deterioration speed of the aromatic primary amine color developing agent. That is, they are the organic compounds functioning to prevent the oxidation of the color developing agent by air. Particularly useful compounds are hydroxylamine derivatives (excluding hydroxylamine), hydroxamic acids, hydrazines, hydrazides, phenols, α-hydroxyketones, α-aminoketones, sucroses, monoamines, diamines, polyamines, quaternary ammonium salts, nitroxy radicals, alcohols, oximes, diamide compounds, and condensed cyclic amines.

In addition to the above compounds, useful are ascorbic acid, glycine, substituted p-aminophenols, phenidones and hydroquinones each described in JP-A-55-21084.

Further, salicylic acids, alkanolamines, polyethyleneimines and aromatic polyhydroxy compounds can be used as preservatives, if desired. Preferably added are alkanolamines such as triethanolamine, dialkylhydroxyamines such as diethylhydroxylamine, a hydrazine, derivative, and an aromatic polyhydroxy compound.

Particularly preferred organic preservatives are hydroxylamine derivatives and hydrazine derivatives (hydrazines and hydrazides) and these compounds are described in detail in JP-A-1-97953, JP-A-1-18693, JP-A-1-186940, and JP-A-1-187557, JP-A-2-191950, JP-A-3-63657 and Japanese Patent Application Nos. 1-198676 and 1-297659.

Use of the above hydroxylamine derivative or hydrazine derivative and amines in combination is preferable to improve the stability of the color developing solution.

Typical examples of the above amines are cyclic amines as described in JP-A-63-239447, amines as described in JP-A-63-128340, and other amines as described in JP-A-1-186939 and JP-A-1-187557.

The amount of the compound shown below which can be added to at least one part of the replenishing solution unit for preparing the color developing solution, where two or more parts are involved, is 0.001 to 1.5 mole/liter, preferably 0.03 to 0.5 mole/liter.

Useful hydroxylamine derivatives are preferably compounds represented by the following Formula (II):

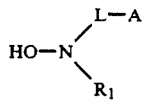

(II)

wherein L represents an group which may be substituted; A represents a carboxyl group, a sulfo group, a phosphono group, a phosphine group, a hydroxyl group, an amino group which may be substituted with an alkyl group, an ammonio group which may be substituted with an alkyl group, a carbamoyl group which may be substituted with an alkyl group, a sulfamoyl group which may be substituted with an alkyl group, or an alkylsulfonyl group which may be substituted; and $R_1$ represents a hydrogen atom or an alkyl group which may be substituted.

In Formula (II), L represents a linear or branched alkylene group having 1 to 10 carbon atoms, preferably 1 to 5 carbon atoms, which may be substituted. Preferred alkylene groups are methylene, ethylene, trimethylene and propylene. Typical examples of substituents for L are a carboxyl group, a sulfo group, a phosphono group, a phosphinic acid residue, a hydroxyl group, and an ammonio group which may be substituted with an alkyl group. Preferred examples of alkylene substituents for L are a carboxyl group, a sulfo group, a phosphono group and a hydroxyl group.

A represents a carboxyl group, a sulfo group, a phosphono group, a phosphinic acid residue, a hydroxyl group, an amino group which may be substituted with an alkyl group, an ammonio group which may be substituted with an alkyl group, a carbamoyl group which may be substituted with an alkyl group, a sulfamoyl group which may be substituted with an alkyl group, or an alkylsulfonyl group which may be substituted. Preferred examples for A are a carboxyl group, a sulfo group, a phosphono group, a hydroxyl group, and a carbamoyl group which may be substituted with an alkyl group.

Preferred specific examples of —L—A are carboxymethyl, carboxyethyl, carboxypropyl, sulfoethyl, sulfopropyl, sulfobutyl, phosphonomethyl, phosphonoethyl, and hydroxyethyl. The particularly preferred examples thereof are carboxymethyl, carboxyethyl, sulfoethyl, sulfopropyl, phosphonomethyl, and phosphonoethyl.

$R_1$ represents a hydrogen atom or a linear or branched alkyl group having 1 to 10 carbon atoms, preferably 1 to 5 carbon atoms, which may be substituted. Typical examples of substituents are a carboxyl group, a sulfo group, a phosphono group, a phosphonic acid residue, a hydroxyl group, an amino group which may be substituted with an alkyl group, an ammonio group which may be substituted with an alkyl group, a carbamoyl group which may be substituted with an alkyl group, a sulfamoyl group which may be substituted with an alkyl group, an alkylsulfonyl group which may be substituted, an acylamino group, an alkylsulfonylamino group, an arylsufonylamino group, an alkoxycarbonyl group, an arylsulfonyl group, a nitro group, a cyano group, a halogen atom. Two or more substituents may be present. Preferred examples of groups represented by $R_1$ are a hydrogen atom, carboxymethyl, carboxyethyl, carboxypropyl, sulfoethyl, sulfopropyl, sulfobutyl, phosphonomethyl, phosphonoethyl, and hydroxyethyl. Particularly preferred examples of groups represented by $R_1$ are hydrogen, carboxymethyl, carboxyethyl, sulfoethyl, sulfopropyl, phosphonomethyl, and phosphonoethyl. L and $R_1$ may combine and form a ring. Further, these compounds may form the salts as well as the salts of above sulfinic acid.

Typical examples of the hydroxylamine derivatives which can be used in the present invention are shown below but the invention is not to be construed as being limited thereto:

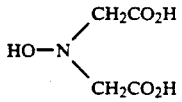
(II-1)

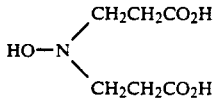
(II-2)

-continued

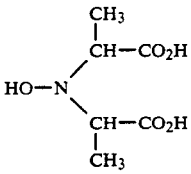
(II-3)

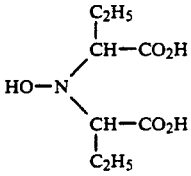
(II-4)

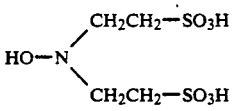
(II-5)

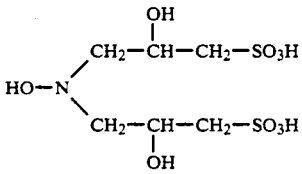
(II-6)

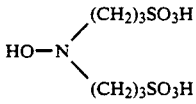
(II-7)

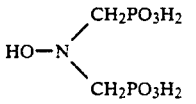
(II-8)

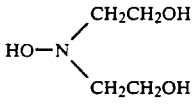
(II-9)

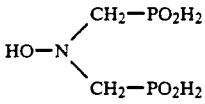
(II-10)

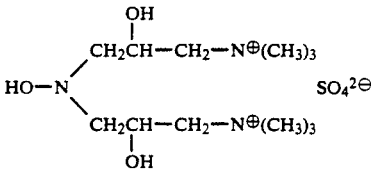
(II-11)

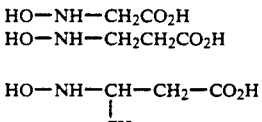
(II-12)

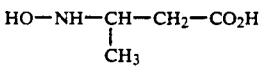
(II-13)

(II-14)

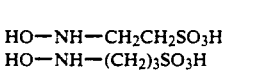
(II-15)

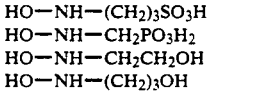
(II-16)

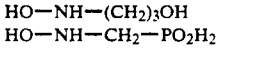
(II-17)

(II-18)

(II-19)

(II-20)

-continued

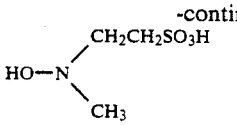
(II-21)

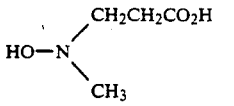
(II-22)

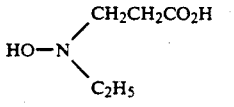
(II-23)

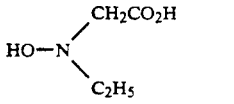
(II-24)

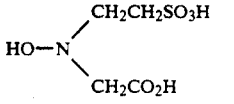
(II-25)

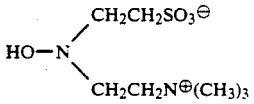
(II-26)

$HONHCH_2CH(PO_3H_2)_2$ (II-27)

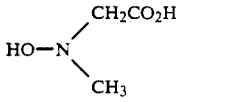
(II-28)

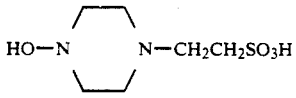
(II-29)

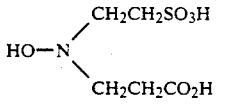
(II-30)

$HO-NHCH_2CH_2C(=O)-NHC(CH_3)_2CH_2-SO_3H$ (II-31)

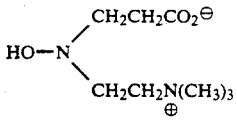
(II-32)

The compounds represented by Formula (II) can be synthesized by subjecting commercially available hydroxylamines to an alkylation reaction (a nucleophilic substitution reaction, an addition reaction, and a Mannich reaction). They can also be synthesized according to the synthetic methods described in German Patent 1,159,634 and *Inorganica Chimica Acta* 93, (1984), pp. 101–108.

In the present invention, when the antioxidation agent and/or the compound represented by formula (II) are used together with the sulfinic acid compound, stability of the developing agent can further be improved and as a result, a replenishing solution unit for preparing a color developing solution excellent in preservability can be obtained.

The replenishing solution A of the present invention preferably contains the above compound represented by formula (II).

The amount of the compound represented by Formula (II) generally used is in the range of 0.001 to 1.5 mol per mol of the p-phenylenediamine developing agent, preferably 0.03 to 0.5 mol per mol of the p-phenylenediamine developing agent.

The developing solution prepared using the replenishing solution unit of the present invention, which consists of two or more parts, preferably has a pH of 9 to 12.0, more preferably 9 to 11.0. At least one of the above parts can contain other conventional developing solution components.

Various kinds of buffer agents are preferably used in order to maintain the above pH. Typical examples of suitable buffer agents are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of the buffer agent in relation to at least one of the parts is preferably 0.1 mol/liter or more, particularly preferably 0.1 to 0.4 mol/liter, in terms of maintaining a buffer action at high pH.

Various kinds of chelating agent as shown in addition to the above chelating agents can be used for at least one part of the two or more parts in order to prevent the precipitation of calcium and magnesium or improve the color developing solution stability.

Of the chelating agents, preferred chelating agents are ethylenediaminetetraacetic acid, catechol-3,4,6-trisulfonic acid, catechol-3,5-disulfonic acid, ethylenetriaminepentaacetic acid, triethylenetetraminehexaacetic acid, 1,3-diaminopropanoltetraacetic acid, ethylendiamine-N,N,N',N'-tetrakis(methylenephosphonic acid), and hydroxyethyliminodiacetic acid.

These chelating agents may be used as a combination of two or more kinds as desired.

These chelating agents may be added to at least one part of the two or more parts of the replenishing solution unit for preparing a color developing solution in the amount sufficient to chelate the metal ions. For example, the specific amount thereof is 0.1 to 10 g/liter.

An appropriate development accelerator can be added to at least one part of the two or more parts forming the replenishing solution unit for preparing the color developing solution.

Typical development accelerators which can be used are the thioether compounds described, in JP-B-37-16088, JP-B-37-5987, JP-B-38-7826, JP-B-44-12380, and JP-B-45-9019, and U.S. Pat. No. 3,813,247; the p-phenylenediamine compounds described in JP-A-52-49829 and JP-A-50-15554; the quaternary ammonium salts described in JP-A-50-137726, JP-B-44-30074, JP-A-56-156826 and JP-A-43429; p-aminophenols described in U.S. Pat. Nos. 2,610,122 and 4,119,462; amine compounds described in U.S. Pat. Nos. 2,494,903, 3,128,182, 4,230,796, 3,253,919, 2,482,546, 2,596,926, and 3,582,346, and JP-B-41-11431; polyalkylene oxide described in JP-B-37-16088, JP-B-42-25201, JP-B-41-

11431 and JP-B-42-23883, and U.S. Pat. Nos. 3,128,183 and 3,532,501; 1-phenyl-3-pyrazolidones; hydrazines; meso-ion type compounds; ion type compounds; and imidazoles. They can be used as necessary.

In the present invention, it is preferable that substantially no benzyl alcohol is present in any of the parts of the replenishing solution unit for preparing the developing solution of the present invention. The term "substantially no benzyl alcohol" means that the amount thereof is 2.0 ml per liter or less of the color developing solution and the amount is preferably zero. Substantially no amount thereof is advantageous in terms of the easiness in preparing the solution and the stability of the solution and further, more preferable results are achieved since the variation of the photographic properties, especially the increase in stain, is small in a continuous processing when the prepared color developing solution is used.

A chloride ion and a bromide ion can be present in the color developing solution (tank solution) prepared by using the replenishing solution unit for preparing the color developing solution of the present invention, which consists of two or more parts for the purpose of preventing a fog.

In the present invention, chloride ion is present in the color developing solution after the preparation in a concentration of preferably $3.5\times10^{-3}$ to $3.0\times10^{-1}$ mol/liter, more preferably $1\times10^{-2}$ to $2\times10^{-1}$ mol/liter. A concentration more than $3.0\times10^{-1}$ mol/liter causes development to be delayed, while a concentration less than $3.5\times10^{-3}$ mol/liter does not prevent stain and can not achieve the object of the present invention since the variation in the photographic properties, especially the minimum density, is increased during continuous processing.

In the present invention, bromide ion is present in the color developing solution after the preparation in a concentration of preferably $0.5\times10^{-5}$ to $1.0\times10^{-3}$ mol/liter, more preferably $3.0\times10^{-5}$ to $5.0\times10^{-4}$ mol/liter, further more preferably $1.0\times10^{-4}$ to $3.0\times10^{-4}$ mol/liter. Where the concentration of the bromide ion is more than $1.0\times10^{-3}$ mol/liter, development is delayed and the maximum density and sensitivity are reduced and where the amount is less than $0.5\times10^{-5}$ mol/liter, the object of the present invention can not be achieved because stain can not be prevented and further, the variation of the photographic properties is increased in the continuous processing.

Chloride ion and bromide ion may be added directly to at least one of the parts, or they may be eluted form the light-sensitive material during development processing when the prepared developing solution is used.

Where chloride ion is added directly to at least one of two or more parts, examples of a chloride ion-providing substances which can be used are sodium chloride, potassium chloride, ammonium chloride, nickel chloride, magnesium chloride, manganese chloride, calcium chloride, and cadmium chloride. Of these substances, preferred are sodium chloride and potassium chloride.

The chloride ion may be present in the form of a counter salt to fluorescent whitening agent to be added to at least one of two or more parts.

Examples of a bromide ion-providing substances are sodium bromide, potassium bromide, ammonium bromide, lithium bromide, calcium bromide, magnesium bromide, manganese bromide, nickel bromide, cadmium bromide, cerium bromide, and thallium bromide. Of these substances, preferred are potassium bromide and sodium bromide.

Where halogen ions are eluted from the light-sensitive material during development, both of the chloride ion and bromide ion may be supplied from an emulsion or a source other than the emulsion.

In the present invention, an appropriate anti-foggant in addition to the chloride ion and bromide ion can be present in at least one of two or more parts as desired.

An alkali metal halide such as potassium iodide and an organic anti-foggant can be used as the anti-foggant. Typical examples of organic anti-foggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine, and adenine.

At least one of the two or more parts forming the replenishing solution unit for preparing the color developing solution of the present invention contains preferably a fluorescent whitening agent. A 4,4'-diamino-2,2'-disulfostilbene compound is preferred as the fluorescent whitening agent. The amount thereof present is 0 to 10 g/liter, preferably 0.1 to 6 g/liter.

Various kinds of a surfactants as desired, including various kinds of the water-soluble polymers such as polyvinylalcohol, polyacrylic acid, polystyrenesulfonic acid, polyacrylamide, polyvinylpyrrolidone, and the copolymers thereof; alkylsulfonic acid; arylsulfonic acid; aliphatic carboxylic acid; and aromatic carboxylic acid can be present.

The processing time with the color developing solution is preferably 5 to 120 seconds, more preferably 10 to 60 seconds, in which the effects of the present invention can be particularly markedly demonstrated. Further, the processing temperature is preferably 33° to 50° C., more preferably 36° to 45° C., in which the effects of the present invention can be particularly markedly demonstrated.

The amount of the color developing solution replenished in a continuous processing depends on the light-sensitive materials and it is 15 to 120 ml/m$^2$, preferably 20 to 60 ml/m$^2$. The above range is preferable since it demonstrates the effects of the present invention. The above replenishing amount is the sum of the replenishing solutions in the respective parts.

Further, the color developing solution of the present invention has relatively superior properties than those of combination outside of the scope of the present invention in any solution-opening rate, wherein the air-opening ratio is defined by the following equation:

$$\text{Solution-Opening Ratio} = \frac{\text{Air-Contact Area (cm}^2)}{\text{Solution Volume (cm}^3)}$$

The solution-opening ratio is preferably 0 to 0.1 cm$^{-1}$ from the standpoint of the color developing solution. During continuous processing, the ratio is preferably in the range of 0.001 to 0.05 cm$^{-1}$, more preferably 0.002 to 0.03 cm$^{-1}$.

In general, it is widely known that where hydroxylamine is used as the preservative, decomposition by heat or a trace amount of metals takes place even if the solution-opening ratio would be set at a small level. In the present invention, however, this decomposition is very small and the color developing solution is sufficiently practical even when it is stored for a long time or it is continuously used as the replenishing solution over a long period of time. Therefore, in such case, the smaller the solution-opening opening ratio is, the more preferable. It is most preferably 0 to 0.002 $cm^{-1}$.

On the contrary, processing is sometimes carried out at a large solution-opening ratio on the condition that the developing solution is discarded after processing in some fixed amount. Even this processing method, excellent performance is demonstrated according to the present invention.

In the present invention, a desilvering processing is carried out after a color development. In general, desilvering consists of a bleaching step and a fixing step and both steps are preferably carried out at the same time.

The desilvering step consists typically of:

(1) bleaching fixing (washing and/or stabilizing),
(2) bleaching bleach-fixing (washing and/or stabilizing),
(3) bleaching - bleach-fixing - fixing - (washing and/or stabilizing),
(4) bleach-fixing - (washing and/or stabilizing),
(5) bleach-fixing fixing (washing and/or stabilizing),
(6) fixing - bleaching - fixing - (washing and/or stabilizing), or
(7) fixing bleach-fixing (washing and/or stabilizing).

The bleaching solution, bleach-fixing solution and fixing solution applicable to the present invention are explained below.

Substantially any bleaching agents can be used as the bleaching agent for the bleaching solution or bleach-fixing solution. Particularly preferred bleaching agents include organic complex salts of iron(III) (for example, the iron(III) complex salts of aminopolycarboxylic acids such as ethylenediaminetetraacetic acid and diethylenetriaminepentaacetic acid, aminopolyphosphonic acid, phosphonocarboxylic acid and organic phosphonic acid); organic acids such as citric acid, tartaric acid and malic acid; persulfate; and hydroperoxide.

Among these compounds, organic complex salts of iron(III) are particularly preferred from the standpoint of rapid processing and prevention of environmental pollution. Typical examples of aminopolycarboxylic acids, aminopolyphosphonic acids, organic phosphonic acids, and the salts thereof, which are useful to form organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These salt may be any of the sodium, potassium, lithium and ammonium salts.

Of these compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred because of a higher bleaching power.

These ferric complex salts may be used in the form of a complex salt or a ferric ion complex salt formed by using ferric salts such as ferric sulfate, ferric chloride, ferric nitrate, ammonium ferric sulfate and ferric phosphate and chelating agents such as aminopolycarboxylic acids, aminopolyphosphonic acids and phosphonocarboxylic acids in a solution. The chelating agents may be used in the excess over that necessity for forming the ferric ion complex salts.

The iron complex salts of aminopolycarboxylic acid are preferred of the iron complex salts. The amount thereof is 0.01 to 1.0 mol/liter, preferably 0.05 to 0.50 mol/liter.

Various compounds can be used as a bleaching accelerator in the bleaching solution, bleach-fixing solution and/or pre-baths thereof. For example, preferred are the compounds having a mercapto group or a disulfide bond, described in U.S. Pat. No. 3,893,858, German Patent 1,290,812, JP-A-53-95630, and *Research Disclosure Vol.* 17129 (July, 1978); the thiourea compounds described in JP-B-45-8506, JP-A-52-20832 and JP-A-53-32735, and U.S. Pat. No. 3,706,561; and halides such as iodide and bromide ions, because of their excellent bleaching power.

The bleaching solution or bleach-fixing solution used in the present invention can contain a rehalogenization agent such as bromides (for example, potassium bromide, sodium bromide and ammonium bromide), chlorides (for example, potassium chloride, sodium chloride and ammonium chloride) and iodides (for example, ammonium iodide).

One or more kinds of the inorganic and organic acids having a pH buffer function, and the alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, or an anti-corrosion agent such as ammonium nitrate and guanidine can be added, as necessary.

The fixing agents used for the bleach-fixing or fixing solution according to the present invention are generally publicly known fixing agents, that is thiosulfates such as sodium thiosulfate and ammonium thiosulfate, thiocyanates such as sodium thiocyanate and ammonium thiocyanate, thioether compounds such as ethylene bisthioglycolic acid and 3,6-dithia-1,8-octanediol and water-soluble silver halide solvents such as thioureas. These compounds can be used alone or as a mixture of two or more kinds.

Further, the specific bleach-fixing solution comprising the combination of a fixing agent and a large amount of halides such as potassium iodide described in JP-A-55-155354 can also be used.

In the present invention, thiosulfates especially ammonium thiosulfate, are preferably used. The amount of the fixing agent is preferably in the range of 0.3 to 2 mol/liter, more preferably 0.5 to 1.0 mol/liter.

The bleach-fixing or fixing solution used in the present invention has preferably a pH in the range of 3 to 8, particularly preferably 4 to 7. While a pH value lower than this level improves desilvering property, deterioration of the solution and the leuconization of a cyan dye are promoted. On the contrary, a pH higher than the above level delays the desilvering and tends to generate a stain.

The bleaching solution used in the present invention has the pH in the range of 8 or lower, more preferably 2 to 7, particularly preferably 2 to 6. A pH lower than this level promotes the deterioration of the solution and the leuconization of a cyan dye and on the contrary, the pH value higher than the above level delays the desilvering and is liable to generate a stain.

Hydrochloric acid, nitric acid, acetic acid, bicarbonate, ammonia, potassium hydroxide, sodium hydroxide, sodium carbonate, and potassium carbonate can be added to adjust the pH, as necessary.

Further, the bleach-fixing solution can contain also a fluorescent whitening agent, a defoaming agent, a surfactant, polyvinylpyrrolidone, and an organic solvent such as methanol.

The bleach-fixing solution and fixing solution used in the present invention can contain as preservative, sulfite ion-releasing compounds such as sulfites (for example, sodium sulfite, potassium sulfite and ammonium sulfite), bisulfites (for example, ammonium bisulfite, sodium bisulfite and potassium bisulfate), and metabisulfites (for example, potassium metabisulfite, sodium metabisulfite and ammonium metabisulfite). These compounds are preferably present in an amount of about 0.02 to 0.50 mol/liter, more preferably about 0.04 to 0.40 mol/liter, converted to sulfite ion. In particular, ammonium sulfite is preferably used.

The sulfites are generally used as a preservative. In addition thereto, ascorbic acid, carbonylbisulfite adducts, sulfinic acids, and carbonyl compounds, may also be present.

Further, a buffering agent, a fluorescent whitening agent, a chelating agent and an anti-mold agent may be added to the bleach-fixing solution or the fixing solution, if necessary.

The processing time with the bleach-fixing solution used in the present invention is 5 to 120 seconds, preferably 10 to 60 seconds. The processing temperature is 25° to 60° C., preferably 30° to 50° C. The replenishing amount thereof is 20 to 250 ml/m$^2$ of a light-sensitive material, preferably 30 to 100 ml/m$^2$ of a light-sensitive material.

In the present invention, the fresh water supplied to a washing (stabilizing) tank may be either city water or well water usually used for washing. However, in order to enhance the prevention of the growth of bacteria in the tanks to which water is supplied and prolong the life of a reverse osmosis membrane, water having calcium and magnesium contents each reduced to 3 mg/liter or lower is preferably used. More specifically, water which is subjected to a deionization processing with an ion exchange resin and by distillation can be advantageously used.

In the present invention, water used for washing and/or stabilizing may be subjected to a treatment with a reverse osmosis membrane. The materials used for the reverse osmosis membrane are cellulose acetate, crosslinked polyamide, polyether, polysulfone, polyacrylic acid, and polyvinylenecarbonate. Particularly preferred are a crosslinked polyamide composite membrane and a polysulfone composite membrane because of there is lesser tendency for water to permeate the membrane.

A multi-stage counter-current flow system with a plurality of tanks is preferably used in the washing and/or stabilizing steps, in which 2 to 5 tanks are particularly preferably used.

Water in or after the second tank of the washing and/or stabilizing steps of such multi-stage counter-current flow system is preferably subjected to treatment with the reverse osmosis. More specifically, there is processed with the reverse osmosis membrane, water in the second tank in the case of a two tanks structure; water in the second or third tank in the case of a three tanks structure; and water in the third or fourth tank in the case of a four thanks structure, wherein the processed and permeated water are returned to the same tank as the tank from which water to be subjected to the treatment with the reverse osmosis membrane is selected (hereinafter referred to as selection tank), or to the washing and/or stabilizing tanks following the above tank. Further, treated water for washing and stabilizing may be sent to the bleach-fixing bath above the selection tank.

The necessary quantity of permeating water supplied depends on the quality of the permeating water (the salt-removing capability of the reverse osmosis membrane), the amount of the light-sensitive material which can be processed in an automatic processing machine, the carry-over amount of the solution from the preceding thank, and the amount of fresh water supplied. It is usually in the range of 1 to 100 times as larger than the amount of fresh water supplied. In the case of a low supply amount (low replenishing amount), it is preferably 5 to 55 times, particularly 10 to 30 times.

It is known to add a fungicide, a chelating agent, a pH buffer agent and a fluorescent whitening agent to the water for washing and/or stabilizing and they may be appropriately selected as desired. It is preferable that these additives are not used in a large amount so that the load on the reverse osmosis membrane is not increased.

Where bacteria grow in a storage tank for fresh water, the storage tank is preferably exposed to ultraviolet light.

The amount of water from the washing step and/or stabilizing step can vary over a wide range depending on the conditions such as the characteristics of the light-sensitive material (for example, depending on the additives such as a coupler present), the applications thereof, the temperature of the water for washing and/or stabilizing, the number of washing (stabilizing) tanks, the replenishing method (such as a counter current or regular current), and others. The relationship of the number of the tanks for washing (stabilizing) with the water quantity in the multi-stage counter current flow system can be obtained by the method described in *Journal of the Society of Motion Picture and Television Engineers,* Vol, 64, pp. 248 to 253 (May, 1955). Usually, the number of the stage in a multi-stage counter current flow system is preferably 2 to 6, particularly 2 to 5.

The amount of water for washing and/or stabilizing can be decreased to a large extent using a multi-stage counter current flow system, in which the level of, for example, 0.5 to 1 liter/m$^2$ of a light-sensitive material is possible; and the effects of the present invention can be clearly demonstrated. However, the prolongation in the residence time of water in the tanks results in bacterial growth causing the suspended matter, formed thereby to stick to the light-sensitive material. The method for reducing calcium and magnesium described in JP-A-62-288838 can be quite effectively used in order to solve such problem. Also, the isothiazolone compounds and thiabendazoles described in JP-A-57-8542, a chlorinated bactericide such as chlorinated sodium isocyanurate described in JP-A-61-120145, benzotriazoles described in JP-A-61-267761, copper ion and other bactericides described in H. Horiguchi, *Chemistry of Anti-bacteria and Anti-mold* published by Sankyo Co. (1986), *Disinfection and Anti-mold technology of Microbials* published by Hygiene Technology Institute (1982), Industrial Technology Society, and *Bactericide and Fungicide Dictionary* published by Nippon Anti-bacteria and Anti-mold Society (1986).

Further, a surfactant as a draining agent and a chelating agent represented by EDTA as a hard water softener can be added to water for washing and/or stabilizing.

Chelating agents selected from aminopolycarboxylic acids, aminopolyphosphonic acids, phosphonocarboxylic acids, alkylidenediphosphonic acids, metaphosphoric acids, pyrophosphoric acids, and polyphosphoric acid can also be used. Particularly, the organic phosphonic acid compound described in Japanese Patent Application No. 2-40940 is preferably used.

Also, direct processing with a stabilizing solution can be conducted after the washing step and/or stabilizing step or without a washing step and/or stabilizing step.

Compounds having the function of stabilizing an image can be added to the stabilizing solution. Typical examples thereof are an aldehyde compound represented by formaldehyde, a buffer agent for adjusting the pH of a layer to a level suitable for stabilizing a dye, and an ammonium compound. Further, the above bactericide and fungicide can be used to prevent bacteria from growing in the solution and provide anti-mold characteristics to a light-sensitive material after processing.

Further, a surfactant, a fluorescent whitening agent and a hardener can also be used.

The chelating agent is used preferably in an amount of 1 to 100 g per liter of the stabilizing solution, more preferably 5 to 50 g per liter of the stabilizing solution.

The washing step and/or stabilizing step generally are conducted at a pH of 4 to 10, more preferably 5 to 8. The temperature can be varied depending on the light-sensitive material. Usually, it is 30° to 60° C., preferably 35° to 50° C.

The processing time can be appropriately set but a shorter time is desirable from the viewpoint of shortening the processing time. Preferably, it is 10 to 45 seconds, particularly 10 to 35 seconds.

A lesser amount of replenishing solution is preferable in terms of savings in running costs, reduction of a drainage and easiness of handling. Also, the object of the present invention can be achieved in a shortened processing time. The replenishing amount is preferably 150 ml or less per $m^2$ of a light-sensitive material. Replenishing may be conducted continuously or intermittently.

The solution used in the washing step and/or stabilizing step can further be used in the preceding steps. An example of the use is an overflow effluent from the washing bath and/or stabilizing both, which is returned by the multi-stage counter-current flow system and supplied to the bleach-fixing bath preceding the washing and/or stabilizing both; a concentrated solution is replenished in the bleach-fixing bath, whereby the amount of a waste can be reduced.

A drying time of 20 to 40 seconds is generally used for a ultra-rapid processing.

Means for shortening the drying time, which are required for a light-sensitive material, include reducing the water content in the layers by reducing the amount of a hydrophilic binder such as gelatin. It is also possible to expedite drying by removing water with a squeeze roller or a cloth in order to reduce the amount of water carried-over. The drying can be expedited by increasing the drying temperature or strengthening the drying power. Further, the drying can be expedited by adjusting the blowing angle of drying air onto a light-sensitive material and removing waste air after drying.

The total processing time in the present invention is defined by the time during which the light-sensitive material contacts the color developing solution and exits from the final both (usually, a washing or stabilizing bath). The effects of the present invention are markedly demonstrated in ultrarapid processing in which this total processing time is 3 minutes or shorter, preferably one and a half minutes or shorter.

The following examples are given to illustrate the present invention in greater detail.

EXAMPLE 1

A replenishing solution A of the following composition containing the color developing agent was prepared.

| | |
|---|---|
| 4-Amino-N-ethyl-N-(β-methanesulfoneamidethyl)-3-methylaniline sesquisulfate monohydrate | 9.5 g |
| Water added to make | 100 ml |
| pH adjusted with 10% KOH solution to | 2.0 |

Sodium sulfite or sodium p-toluenesulfinate monohydrate was added to the above solution in various amounts to prepare Solution Nos. 1 to 21. The amount thereof added and the pH's are shown in Table 1 below. Each of the solutions having the compositions shown in Table 1 was put in a glass vessel having the solution-opening ratio (surface area $cm^2$/volume $cm^3$) of 0.06 and the glass vessel was left to stand at a constant-temperature at 40° C. for eight weeks.

Evaporated water was added to adjust the volume and then, the amount of the color developing agent was measured using high-speed liquid chromatography, wherein a 25% aqueous solution of acetonitrile was used as an extracting solution and the amount was obtained from the absorption peak at 254 nm.

The degree of coloring of the stored solutions was visually observed and classified into following five grades:

A: little coloring
B: a little blue coloring
C: dense red purple
D: very densely colored and impossible to judge the kind of color

TABLE 1

| Solution No. | Sodium Sulfite (g) | p-Toluene Sulfinate (g) | pH | Coloring Degree | Residual Rate (%) |
|---|---|---|---|---|---|
| 1 (Comp.) | — | — | 1.5 | D | 15 |
| 2 (Comp.) | — | — | 2.0 | D | 22 |
| 3 (Comp.) | — | — | 3.0 | D | 35 |
| 4 (Comp.) | — | — | 4.0 | D | 37 |
| 5 (Comp.) | — | — | 5.0 | D | 30 |
| 6 (Comp.) | — | — | 6.0 | D | 25 |
| 7 (Comp.) | — | — | 7.0 | D | 18 |
| 8 (Comp.) | 0.3 | — | 2.0 | D | 30 |
| 9 (Comp.) | 0.3 | — | 3.0 | D | 60 |
| 10 (Comp.) | 0.3 | — | 5.0 | D | 65 |
| 11 (Comp.) | 0.3 | — | 6.0 | D | 63 |
| 12 (Comp.) | 0.7 | — | 2.0 | B | 65 |
| 13 (Comp.) | 0.7 | — | 4.0 | C | 75 |
| 14 (Comp.) | — | 0.2 | 1.5 | A | 76 |
| 15 (Inv.) | — | 0.2 | 2.0 | A | 90 |
| 16 (Inv.) | — | 0.2 | 3.0 | B | 91 |
| 17 (Inv.) | — | 0.2 | 5.0 | B | 89 |
| 18 (Inv.) | — | 0.2 | 6.0 | B | 88 |
| 19 (Comp.) | — | 0.2 | 7.0 | D | 84 |
| 20 (Inv.) | — | 0.8 | 2.0 | A | 90 |
| 21 (Inv.) | — | 0.8 | 5.0 | B | 91 |

It can be seen from the results shown in Table 1 above that solutions containing only the color developing agent are heavily colored even at pH of neutral or lower and that the residual amount of the color developing agent is low. Also, the addition of the conventional sulfite improves the residual rate of the developing agent but still this improvement is insufficient. It has been found that the addition of the sulfinic acid salt according to the present invention provides the less coloring and higher residual rate of the color developing agent in the pH range of 2 to 6.

EXAMPLE 2

The effect of the sulfinic acid and the salt thereof of the invention was investigated. Solution Nos. 22 to 29 were prepared in the same manner as in Example 1 except that sulfinic acid or a salt thereof was added as shown in Table 2 below. The solutions thus prepared were evaluated in the same manner as in Example 1. The results obtained are shown in Table 2.

TABLE 2

| Solution No. | Sulfinic Acid or Salt | pH | Coloring Degree | Residual Rate (%) |
|---|---|---|---|---|
| 22 (Inv.) | S-2 (2 mmol) | 3.0 | B | 89 |
| 23 (Inv.) | S-3 (2 mmol) | 3.0 | B | 90 |
| 24 (Inv.) | S-18 (2 mmol) | 3.0 | B | 90 |
| 25 (Inv.) | S-21 (2 mmol) | 3.0 | B | 87 |
| 26 (Inv.) | S-35 (2 mmol) | 3.0 | B | 86 |
| 27 (Inv.) | S-37 (2 mmol) | 3.0 | B | 90 |
| 28 (Inv.) | S-39 (2 mmol) | 3.0 | B | 90 |
| 29 (Inv.) | S-42 (2 mmol) | 3.0 | B | 88 |

EXAMPLE 3

Solution Nos. 30 to 37 were prepared in the same manner as in Example 1 except that an antioxidation agent was added to the replenishing solution A containing the color developing agent to determine the effect of the combined use thereof. The solutions thus prepared were evaluated in the same manner as in Example 1. The results are shown in Table 3 below.

TABLE 3

| Solution No. | Sulfinic Acid or Salt | Anti-Oxidation Agent | pH | Coloring Degree | Residual Rate (%) |
|---|---|---|---|---|---|
| 30 (Inv.) | S-3 (4 mmol) | — | 3.5 | B | 90 |
| 31 (Inv.) | S-3 (4 mmol) | A (1 mmol) | 3.5 | B | 92 |
| 32 (Inv.) | S-3 (4 mmol) | A (6 mmol) | 3.5 | A | 93 |
| 33 (Inv.) | S-3 (4 mmol) | B (6 mmol) | 3.5 | B | 93 |
| 34 (Inv.) | S-3 (4 mmol) | II-2 (6 mmol) | 3.5 | B | 97 |
| 35 (Inv.) | S-3 (4 mmol) | II-5 (6 mmol) | 3.5 | B | 97 |
| 36 (Inv.) | S-3 (4 mmol) | II-21 (6 mmol) | 3.5 | B | 98 |
| 37 (Inv.) | S-3 (4 mmol) | II-32 (6 mmol) | 3.5 | B | 97 |

A: sodium sulfite, B: sodium ascorbate.

It can be seen from the results shown in Table 3 above that the combined used of an anti-oxidation agent improves the residual rate of the color developing agent. Particularly, the combined use of a dialkylhydroxylamine according to the present invention further improves the residual rate.

That is, the use of an anti-oxidation agent and a compound represented by Formula (II) in combination with the sulfinic acid or salt thereof further improves the stability of the developing agent and enables a replenishing solution for preparing a color developing solution, which has an excellent storage property, to be obtained.

EXAMPLE 4

The emulsion layer-coating solutions were coated on a paper support laminated on the both sides with polyethylene to prepare a multi-layer color printing paper. The coating solutions were prepared in the following manner.

Preparation of First Layer-Coating Solution

To 19.1 g of yellow coupler (ExY), 4.4 g of image stabilizer (Cd-1) and 0.7 g of color image stabilizer (Cd-7) were added 27.2 ml of ethyl acetate and 8.2 g of solvent (Solv-1) for dissolving and this solution was emulsified and dispersed in 185 ml of a 10% gelatin aqueous solution containing 8 ml of sodium dodecylbenzene sulfonate.

Meanwhile, a silver chlorobromide emulsion was prepared, wherein the silver halide grains were cubic grains; the emulsion was a mixture (3:7 by mol) of grains having average grain sizes of 0.88 μm and 0.70 μm, respectively; the coefficients of variation were 0.08 and 0.10, respectively; and the respective grains had a localized silver bromide content of 0.2 mol % on the surfaces thereof. The following blue-sensitive sensitizing dye was added to this emulsion in amounts of $2.0\times10^{-4}$ mol/mol of silver to the emulsion and $2.5\times10^{-4}$ mol/mol of silver to the small grain size emulsion, and the emulsion thus prepared was sulfur sensitized.

The above emulsion containing the yellow coupler and the emulsion containing the silver chlorobromide grains were mixed to prepare a First Layer coating solution having the following composition.

The Second to Seventh Layer coating solutions were prepared in the same manner as the First Layer coating solution. Sodium 1-oxy-3,5-dichloro-s-triazine was used as a gelatin hardener.

The following compounds were used as spectral sensitizers for the respective layers.

Blue-sensitive Sensitizers

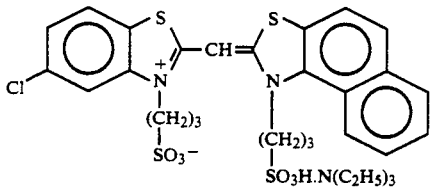

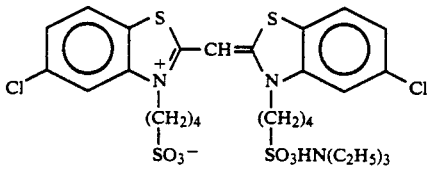

($2.0\times10^{-4}$ mol/mol of silver halide to the large grain size emulsion and $2.5\times10^{-4}$ mol/mol of silver halide to the small grain size emulsion, respectively).

Green-Sensitive Sensitizers

-continued

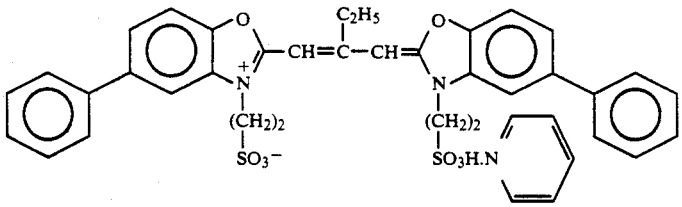

($4.0\times10^{-4}$ mol/mol of silver halide to the large grain size emulsion and $5.6\times10^{-4}$ mol/mol of silver halide to the small grain size emulsion, respectively).

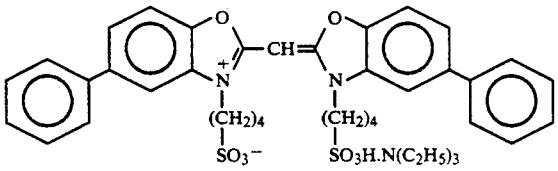

($7.0\times10^{-5}$ mol/mol of silver halide to the large grain size emulsion and $1.0\times10^{-5}$ mol/mol of silver halide to the small grain size emulsion, respectively).

Red-Sensitive Sensitizers

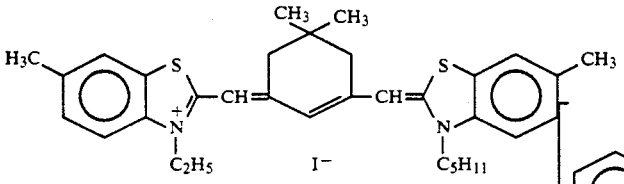

($0.9\times10^{-4}$ mol/mol of silver halide to the large grain size emulsion and $1.1\times10^{-4}$ mol/mol of silver halide to the small grain size emulsion, respectively).

The following compound was added to the red-sensitive layer in an amount of $2.6\times10^{-3}$ per mol of silver halide:

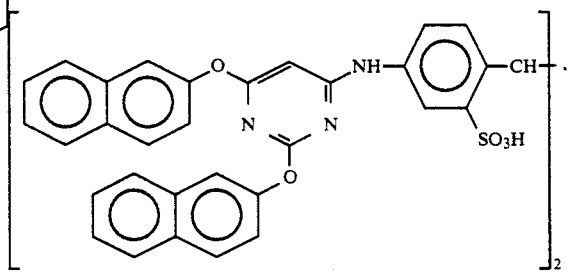

Further, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$, $7.7\times10^{-4}$ and $2.5\times10^{-4}$ mol per mol of silver halide, respectively.

Also, 4-hydroxy-6-methyl-1,3,3a,7-tetrazaindene was added to the blue-sensitive emulsion layer and the green-sensitive layer in amounts of $1\times10^{-4}$ mol and $2\times10^{-4}$ mol per mol of silver halide, respectively.

The following anti-halation dyes were added to the emulsion layers.

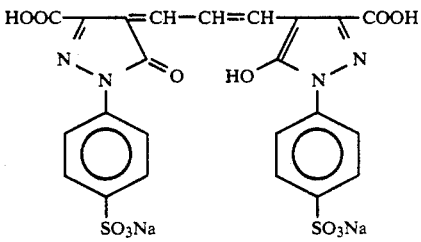

-continued

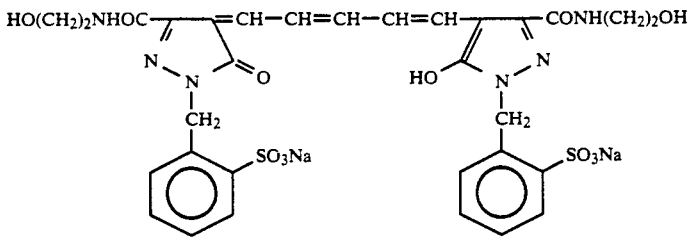

Layer Structure

The compositions of the respective layers are shown below. The units are in by g/m$^2$. The amount of silver halide emulsion is expressed as the amount converted to silver.

Support

Polyethylene-Laminated Paper (a white pigment ($TiO_2$) and ultramarine were added to polyethylene on the side of the first layer).

| | |
|---|---|
| First Layer (blue-sensitive layer): | |
| Silver Chlorobromide Emulsion (as above) | 0.30 |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer (anti-color mixing layer): | |
| Gelatin | 0.99 |
| Anti-Color Mixing Agent (Cpd-5) | 0.08 |
| Solvent (Solv-1) | 0.16 |
| Solvent (Solv-4) | 0.08 |
| Third Layer (green-sensitive layer): | |
| Silver Chlorobromide Emulsion (cubic grains, mixture (1:3 by mol) of the grains having average grain sizes of 0.55 μm and 0.39 μm; coefficients of variation of grain sizes: 0.10 and 0.08; and localized AgBr content of 0.8 mol % on surface) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.04 |
| Fourth Layer (UV absorbing layer): | |
| Gelatin | 1.58 |
| UV Absorber (UV-1) | 0.47 |
| Anti-Color Mixing Agent (Cpd-5) | 0.05 |
| Solvent (Solv-5) | 0.24 |
| Fifth Layer (red-sensitive layer): | |
| Silver chlorobromide emulsion (cubic grains, mixture (1:4 by mol) of grains having average grain sizes of 0.58 μm and 0.45 μm; coefficients of variation of grain sizes: 0.09 and 0.11; and localized AgBr content of 0.6 mol % on surface) | 0.23 |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer (UV absorbing layer): | |
| Gelatin | 0.53 |
| UV Absorber (UV-1) | 0.16 |
| Anti-Color Mixing Agent (Cpd-5) | 0.02 |
| Solvent (Solv-5) | 0.08 |
| Seventh Layer (protective layer): | |
| Gelatin | 1.33 |
| Acryl-modified Copolymer of Polyvinyl-alcohol (modification: 17%) | 0.17 |
| Fluid Paraffin | 0.03 |

Yellow Coupler (ExY)

-continued
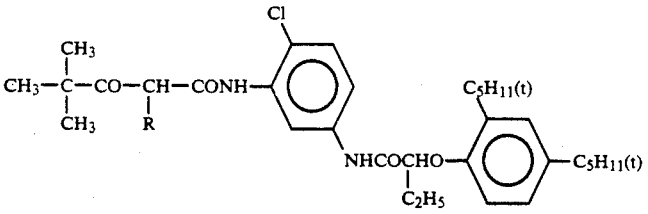
mixture (1:1 by mole) of
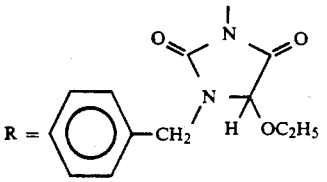
and
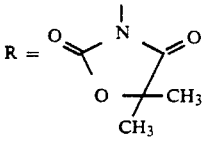
Magenta Coupler (ExM)
mixture (1:1 by mole) of
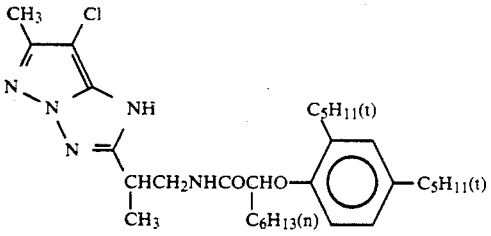
and
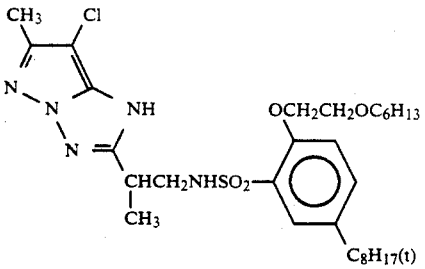
Cyan Coupler (ExC)
mixture (2:4:4 by weight) of
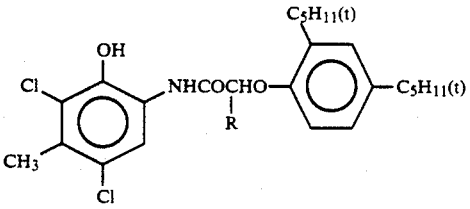
R = $C_2H_5$ and R = $C_4H_9$, and -continued
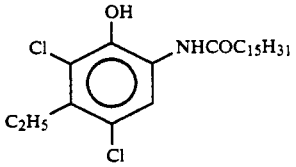
Color Image Stabilizer (Cpd-1)
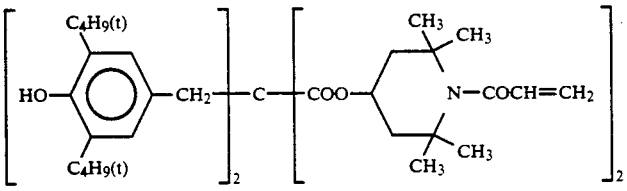
Color Image Stabilizer (Cpd-2)
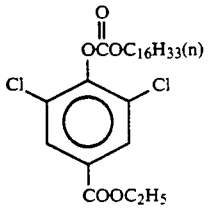
Color Image Stabilizer (Cpd-3)
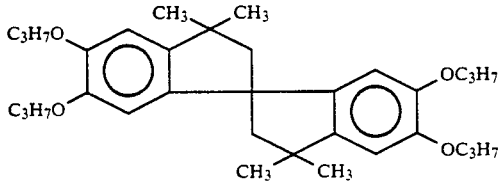
Color Image Stabilizer (Cpd-4)
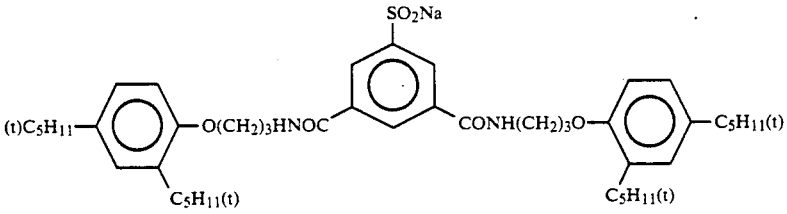
Anti-Color Mixing Agent (Cpd-5)
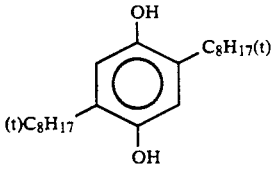
Color Image Stabilizer (Cpd-6)
mixture (2:4:4 by weight) of
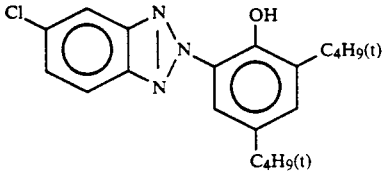

-continued
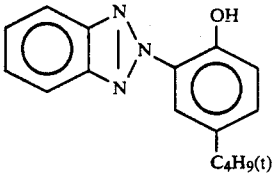
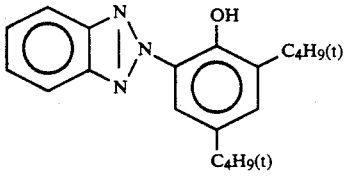
Color Image Stabilizer (Cpd-7)
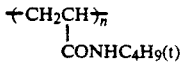
(Average molecular weight: 60,000)
Color Image Stabilizer (Cpd-8)
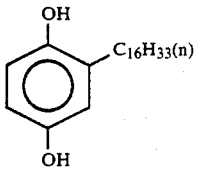
Color Image Stabilizer (Cpd-9)
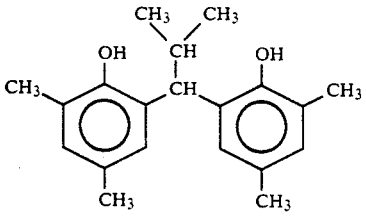
UV Absorber (UV-1)
mixture (4:2:4 by weight) of
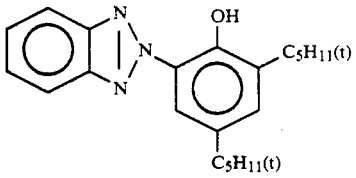
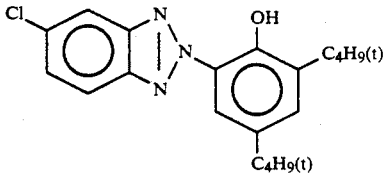
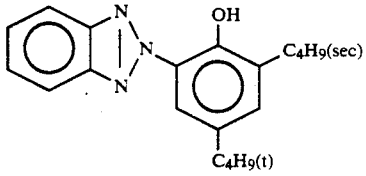
Solvent (Solv-1)

-continued

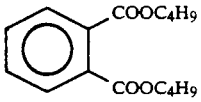

Solvent (Solv-2)

mixture (2:1 by volume) of

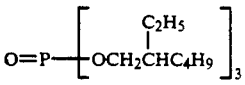

and

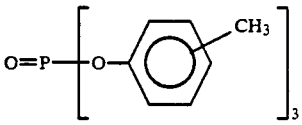

Solvent (Solv-4)

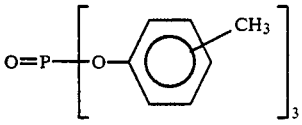

Solvent (Solv-5)

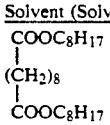

Solvent (Solv-6)

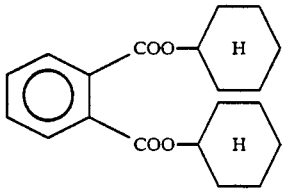

A part of the light-sensitive paper samples subjected to the processing with the replenishing solutions of the present invention was subjected to a gradation exposure through a three color-separation filter using a sensitometer (FWH type, color temperature of a light source: 3200° K., manufactured by Fuji Photo Film Co., Ltd.) (procedure A). Another part of each the light-sensitive material samples were subjected to a gradation exposure through a gray optical wedge without using the three color-separating filter. The B, G and R component of the light were adjusted with yellow and magenta filters.

The above exposure was carried out so that the exposure become 2500 CMS with an exposure time of 0.1 second.

The exposed samples were subjected to the following processings with processing solutions having the following compositions.

The composition of the first development replenishing solution was changed as shown in Table 4 below and the solutions were stored for 4 weeks under the same conditions as in Example 1 to check the variation in the photographic properties before and after storage.

| Processing Step | Temperature (°C.) | Time (seconds) |
|---|---|---|
| Developing | 42 | 20 |
| Bleach-fixing | 40 | 20 |
| Washing (1) | 40 | 7 |
| Washing (2) | 40 | 7 |
| Washing (3) | 40 | 7 |
| Drying | 70–80 | 15 |

Color Developing Solution

First Replenishing Solution:

| | |
|---|---|
| 4-Amino-3-methyl-N-ethyl-N-[β-(methanesulfoneamide)ethyl] Aniline.3/2 Sulfate.1 hydrate | 9.50 g |
| Additives other than the above developing agent which were used are shown in Table 4 below. | |
| Water was added to make the total quantity | 100 ml |

Second Replenishing Solution:

| | |
|---|---|
| Triethanolamine | 11.6 g |
| Sodium N,N-bis(2-Sulfoethyl)-hydroxylamine | 11.0 g |
| Fluorescent Whitening Agent (WHITEX 4B manufactured by Sumitomo Chemical Company, Ltd.) | 2.0 g |
| Pentasodium Aminotri(methylenesulfonic acid) | 3.0 g |
| Potassium Carbonate | 25.0 g |

-continued

| | |
|---|---|
| Water was added to make the total quantity | 200 ml |
| pH (25° C.) | 10.9 |

Third Replenishing Solution

Potassium Hydroxide (10% aq. soln.)

The three replenishing solutions thus prepared and the other additives were mixed as follows to prepare tank solutions.

| | |
|---|---|
| Developing Solution (tank solution) | |
| First Replenishing Solution | 100 ml |
| Second Replenishing Solution | 140 ml |
| Potassium Bromide | 0.035 g |
| Potassium Chloride | 10 g |
| Water was added to make the total quantity | 1000 ml |
| pH (25° C.) was adjusted to with the third replenishing solution | 10.35 |
| Bleach Fixing Solution (tank solution same as replenishing solution) | |
| Water | 400 ml |
| Ammonium Thiosulfate (70% aq. soln.) | 100 ml |
| Ammonium Sulfite | 15 g |
| Ammonium Fe(III) Ethylenediaminetetraacetate | 77 g |
| Disodium Ethylenediaminetetraacetate | 5 g |
| Sodium Bromide | 40 g |
| Water was added to make the total quantity | 1000 ml |
| pH (25° C.) | 6.0 |
| Rinsing Solution (tank solution same as replenishing solution) | |
| City water | |

Washing was carried out using a three-stage counter-current flow system in which the overflowing solution was sent from the third bath to the first bath.

The densities of the yellow, magenta and cyan color images thus obtained were measured using a densitometer to obtain characteristic curves, and the relative sensitivities of the respective color images were calculated therefrom. The coloring degree was evaluated in the same manner as in Example 1. The results of these evaluations are shown in Table 4 below.

a color developing agent of the present invention makes it possible to prepare a highly concentrated developing solution and decrease the coloring and tar as well as to control the variation in the photographic properties within a narrow range.

EXAMPLE 5

The light-sensitive paper samples subjected to the processing with the replenishing solutions of the present invention were subjected to a gradation exposure through a three color-separation filter using a sensitometer (FW type, color temperature of a light source: 3200° K., manufactured by Fuji Photo Film Co., Ltd.).

The exposed samples were subjected to the following processing with processing solutions having a the following compositions.

| Processing Step | Temp. (°C.) | Time (sec.) | Replenishing Amount (ml/m²) | Tank Volume (liter) |
|---|---|---|---|---|
| Developing | 40 | 20 | shown below | 2 |
| Bleach-fixing | 40 | 15 | 60 | 2 |
| Rinse (1) | 40 | 5 | — | 1 |
| Rinse (2) | 40 | 5 | — | 1 |
| Rinse (3) | 40 | 5 | — | 1 |
| Rinse (4) | 40 | 5 | — | 1 |
| Rinse (5) | 40 | 5 | 60* | 1 |
| Drying | 60–80 | 15 | | |

*:Five stage counter flow system from Rinse (5) to Rinse (1).

Water to be used in rinse step was transferred to a reverse osmosis membrane to supply the permeated water to Rinse (5). Further, the concentrated water which did not permeate the reverse osmosis membrane was returned to Rinse (4) and used.

| | |
|---|---|
| Color Developing Solution | |
| First Replenishing Solution: | |
| 4-Amino-3-methyl-N-ethyl-N-[β-(methanesulfoneamide)ethyl] Aniline.3/2 Sulfate.1 hydrate | 9.5 g |
| Sulfinic acid salt (shown in Table 5) | 0.003 mol |
| Sodium Sulfite | 0.06 g |
| 1,2-Dihydroxybenzene-4,6-disulfonic acid disodium | 0.5 g |
| Water to make | 100 ml |

TABLE 4

| First Replenishing Solution No. | First Replenishing Solution: Sulfinic Acid or Salt | Anti-Oxidation Agent | pH | Storage 40° C., 4 weeks | Sensitivity* B | G | R | Coloring Degree |
|---|---|---|---|---|---|---|---|---|
| 38 (Comparison) | — | — | 3.0 | — | 100 | 100 | 100 | C |
| 39 (Comparison) | — | — | 3.0 | done | 50 | 63 | 79 | D |
| 40 (Invention) | I-2 (4 mmol) | — | 3.0 | — | 100 | 100 | 100 | B |
| 41 (Invention) | I-2 (4 mmol) | — | 3.0 | done | 95 | 98 | 100 | B |
| 42 (Comparison) | — | $Na_2SO_3$ (1 mmol) | 3.0 | — | 93 | 95 | 95 | C |
| 43 (Comparison) | — | $Na_2SO_3$ (1 mmol) | 3.0 | done | 52 | 65 | 81 | D |
| 44 (Invention) | I-2 (4 mmol) | $Na_2SO_3$ (1 mmol) | 3.0 | — | 98 | 98 | 99 | B |
| 45 (Invention) | I-2 (4 mmol) | $Na_2SO_3$ (1 mmol) | 3.0 | done | 100 | 100 | 100 | B |
| 46 (Comparison) | — | I-7 (4 mmol) | 3.0 | — | 100 | 100 | 100 | C |
| 47 (Comparison) | — | I-7 (4 mmol) | 3.0 | done | 52 | 63 | 81 | D |
| 48 (Invention) | S-3 (4 mmol) | I-7 (4 mmol) | 3.0 | — | 100 | 100 | 100 | B |
| 49 (Invention) | S-3 (4 mmol) | I-7 (4 mmol) | 3.0 | done | 98 | 100 | 100 | B |
| 50 (Comparison) | S-3 (4 mmol) | — | 1.5 | — | 98 | 98 | 98 | A |
| 51 (Comparison) | S-3 (4 mmol) | — | 1.5 | done | 71 | 79 | 89 | A |
| 52 (Invention) | S-3 (4 mmol) | — | 5.5 | — | 100 | 100 | 100 | B |
| 53 (Invention) | S-3 (4 mmol) | — | 5.5 | done | 97 | 98 | 100 | B |
| 54 (Comparison) | S-3 (4 mmol) | — | 7.0 | — | 98 | 100 | 100 | C |
| 55 (Comparison) | S-3 (4 mmol) | — | 7.0 | done | 74 | 83 | 91 | D |

*Sensitivity is expressed as a relative sensitivity to that of the light-sensitive material processed using First Replenishing Solution No. 40, which is set at 100.

As is apparent from the results summarized in Table 4 above, the use of a replenishing solution A containing -continued

| | |
|---|---|
| pH (25° C.) | 3.5 |
| Second Replenishing Solution: | |
| Triethanolamine | 8.0 g |
| Disodium N,N-bis(2-sulfonatoethyl)-hydroxylamine | 4.6 g |
| Triisopropylnaphthalene (β)sulfonic acid sodium | 0.1 g |
| Ethylenediamine tetraacetic acid | 2.0 g |
| Fluorescent Whitening Agent (UVITEX CK, manufactured by Ciba-Geigy) | 0.5 g |
| Potassium Carbonate | 16.0 g |
| Water to make | 200 ml |
| pH (25° C.) | 13.4 |
| Color Developing Solution (Tank Solution) | |
| First Replenishing Solution | 100 ml |
| Second Replenishing Solution | 200 ml |
| Potassium Carbonate | 15 g |
| KCl | 10 g |
| KBr | 0.03 g |
| Water to make | 1000 ml |
| pH (25° C.) | 10.35 |
| Replenishing amount of first replenishing solution: 12.4 ml per $m^2$ of the light-sensitive material | |
| Replenishing amount of second replenishing solution: 20.0 ml per $m^2$ of the light-sensitive material | |

| Bleach-Fixing Solution | Tank Solution |
|---|---|
| Water | 500 ml |
| Ammonium Thiuosulfate (70% aq. soln.) | 100 ml |
| Ammonium Sulfite | 40 g |
| Ammonium Fe(III) Ethylenediamine-tetraacetate | 77 g |
| Disodium Ethylenediamine-tetraacetate | 5 g |
| Ammonium Chloride | 42 g |
| Acetic Acid (50%) | 25 ml |
| Water to make | 1000 ml |
| pH (25° C.) was adjusted to with the acetic acid and aqueous ammonia (Replenishing solution has the same composition as the tank solution except that pH is 5.0.) | 5.8 |

Rinsing Solution

Ion exchanged water (having calcium and magnesium each in an amount of 3 ppm or less)

Each of the first replenishing solutions of the color developing solution having the compositions shown in Table 5 was introduced into a vessel made of vinyl chloride having a solution-opening ratio of 0.2 and was left for 4 weeks. The thus stored solutions were used as the replenishing solutions for replenishing and were subjected to a continuous processing (running processing) so that the replenishing amount becomes twice the tank volume. The densities of the yellow, magenta and cyan color images thus obtained were measured using a densitometer to obtain characteristic curves, and the relative sensitivities of the respective color images were calculated therefrom. The solutions thus stored were evaluated in the same manner as in Example 1. The results obtained are shown in Table 5.

TABLE 5

| 1st Replenishing Solution No. | Sulfinic Acid or Salt | Dmin | | | Relative Sensitivity | | | Coloring Degree |
|---|---|---|---|---|---|---|---|---|
| | | B | G | R | B | G | R | |
| 56 (Comp.) | none | 0.14 | 0.15 | 0.22 | 70 | 78 | 85 | C |
| 57 (Inv.) | S-7 | 0.11 | 0.10 | 0.14 | 94 | 97 | 100 | B |
| 58 (Inv.) | S-3 | 0.11 | 0.10 | 0.14 | 95 | 97 | 100 | B |
| 59 (Inv.) | S-38 | 0.11 | 0.10 | 0.14 | 100 | 100 | 100 | A |
| 60 (Inv.) | S-39 | 0.11 | 0.10 | 0.14 | 100 | 100 | 100 | A |
| 61 (Inv.) | S-43 | 0.11 | 0.10 | 0.14 | 100 | 100 | 100 | A |
| 62 (Inv.) | S-45 | 0.11 | 0.10 | 0.14 | 100 | 100 | 100 | A |

As is apparent from Table 5, by using the replenishing solution unit for preparing the color developing solution of the present invention, a low replenishing processing is possible and the coloring of the developing solution is less even after the running processing.

Further, stable photographic characteristics can be obtained without forming the precipitation and with less fluctuation in sensitivity by using a water-soluble sulfinic acid or a salt thereof.

According to the present invention, sulfinic acid or salt thereof can be added to the replenishing solution A containing the color developing agent to obtain a replenishing solution unit for preparing a high concentrated developing solution which is stable even at low pH.

Also, the images of an excellent quality can be obtained even in a low replenishing rate by processing a color light-sensitive material with the developing solution prepared by adding separately or mixing the replenishing solution A containing the color developing agent and the replenishing solution B containing the replenishing components other than the color developing agent to the developing solution.

In addition, according to the present invention, the formation of turbidity or suspended matter in the developing solution can be prevented. Therefore, any troubles in the replenishing tank for color developing (e.g., trouble in opening and shuting values) can be removed.

While the invention has been described in detail and with reference to specific embodiments thereof, it will be apparent to one skilled in the art that various changes and modifications can be made therein without departing from the spirit and scope thereof.

What is claimed is:

1. A replenishing solution unit for color-developing a color photographic light-sensitive material, comprising at least (1) a replenishing solution containing an aromatic primary amine color developing agent and a sulfinic acid or a salt thereof and the pH of said replenishing solution is 2 to 6 and (2) a replenishing solution containing a replenishing solution component other than the color developing agent.

2. The replenishing solution unit as in claim 1, wherein the sulfinic acid or a salt thereof is a compound represented by formula (I):

$$R(SO_2M)_n \quad (I)$$

wherein R represents an alkyl group, an alkenyl group, an aralkyl group, a cycloalkyl group, an aryl group or a heterocyclic group, M represents a cation, and n is an integer of 1 or 2, provided that when R is an alkyl group, an alkenyl group, an aralkyl group or a cycloalkyl group, n is 1.

3. The replenishing solution unit as in claim 2, wherein R is a substituted or unsubstituted aryl group or a substituted or unsubstituted heterocyclic group.

4. The replenishing solution unit as in claim 2, wherein R is an aryl group substituted by at least one of an alkyl group having a carboxylic acid or a salt thereof or a sulfonic acid or a salt thereof, an alkoxy group having a carboxylic acid or a salt thereof or a sulfonic acid or a salt thereof and an alkylamino group having a carboxylic acid or a salt thereof or a sulfonic acid or a salt thereof.

5. The replenishing solution unit as in claim 1, wherein the amount of the aromatic primary amine color developing agent in the replenishing solution (1) is 5 to 450 g/liter.

6. The replenishing solution unit as in claim 1, wherein the pH of the replenishing solution (1) is 2.5 to 5.5.

7. The replenishing solution unit as in claim 1, wherein the replenishing solution (1) further comprises a hydroxylamine derivative represented by formula (II):

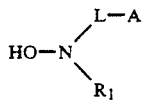

(II)

wherein L represents an alkylene group which may be substituted; A represents a carboxyl group, a sulfo group, a phosphono group, a phosphine group, a hydroxyl group, an amino group which may be substituted with an alkyl group, an ammonio group which may be substituted with an alkyl group, a carbamoyl group which may be substituted with an alkyl group, a sulfamoyl group which may be substituted with an alkyl group, or an alkylsulfonyl group which may be substituted; and R represents a hydrogen atom or an alkyl group which may be substituted.

8. The replenishing solution unit as in claim 1, wherein the amount of the sulfinic acid or a salt thereof is 0.001 to 1.0 mol/liter.

9. A method for processing a color photographic light-sensitive material in color development comprising using a replenishing solution unit comprising at least (1) a replenishing solution containing an aromatic primary amine color developing agent and a sulfinic acid or a salt thereof wherein the pH of said solution is 2 to 6 and (2) a replenishing solution containing a replenishing solution component other than the developing agent, and the method comprises adding the replenishing solution containing the developing agent to a color developing solution separately from the replenishing solution containing a replenishing solution component other than the developing agent or by mixing such with a third replenishing solution.

10. The method for processing a color photographic light-sensitive material in color development as in claim 9, wherein the amount of the aromatic primary amine color developing agent used in color development is 0.0002 to 0.2 mol per liter of the color developing solution.

11. The method for processing a color photographic light-sensitive material in color development as in claim 9, wherein the amount of the aromatic primary amine color developing agent used in color development is 0.001 to 0.1 mol per liter of the color developing solution.

12. The method for processing a color photographic light-sensitive material in color development as in claim 9, wherein the amount of the color developing solution replenished is 20 to 60 ml/m$^2$.

* * * * *